US005695161A

United States Patent [19]

Brozak, Jr.

[11] Patent Number: 5,695,161

[45] Date of Patent: Dec. 9, 1997

[54] HINGED PRODUCT DISPLAY CLIP

[75] Inventor: Emory N. Brozak, Jr., Strongsville, Ohio

[73] Assignee: American Greetings Corporation, Cleveland, Ohio

[21] Appl. No.: 575,574

[22] Filed: Dec. 20, 1995

[51] Int. Cl.[6] ..... A47B 96/06

[52] U.S. Cl. ..... 248/215; 24/543; 223/94; 248/305; 248/308

[58] Field of Search ..... 248/214, 215, 248/308, 305, 332, 340, 691; 223/94, 89; 24/543, 559, 487

[56] References Cited

U.S. PATENT DOCUMENTS

| | | | |
|---|---|---|---|
| 3,065,946 | 11/1962 | Berkow | 248/215 X |
| 3,568,852 | 3/1971 | Howard | 211/113 |
| 4,132,316 | 1/1979 | Schmidt, Jr. | 211/13 |
| 4,346,825 | 8/1982 | Leger | 211/113 X |
| 4,416,038 | 11/1983 | Morrone, III | 24/487 |
| 4,718,546 | 1/1988 | Kolton et al. | 211/113 X |
| 4,802,804 | 2/1989 | Hirohata | 411/433 |
| 5,363,539 | 11/1994 | Tisol | 24/543 |
| 5,535,969 | 7/1996 | Duffy, Jr. | 24/487 X |

*Primary Examiner*—Ramon O. Ramirez
*Attorney, Agent, or Firm*—Calfee, Halter & Griswold LLP

[57] ABSTRACT

A hinged product display clip for gripping a product for suspension from a product display structure has a front panel with a hook and a dual hinge member integrally attached along a first hinge to a lateral edge of the front panel and along a second hinge to a rear panel closeable about the hinge member relative to the front panel to form a product receiving channel and lockable with the front panel in a closed position to firmly grip a product in the channel between the front and rear panels for suspended display.

5 Claims, 3 Drawing Sheets

HINGED PRODUCT DISPLAY CLIP

FIELD OF THE INVENTION

The present invention pertains in general to fastening and hanging devices and in particular to hangers and clips for suspended product display.

BACKGROUND OF THE INVENTION

In retail product merchandising it is desirable to organize, support and display product in an accessible and aesthetically attractive manner which enables products to be easily and densely stocked, removed from the display for examination and returned to the display in an orderly manner. For products which are to be suspended from hooks or racks, some sort of hook or hanger or clip is typically required to provide a balanced hanging point and which engages the product to be suspended without damage to the product. Such hangers must grip the products with substantial force to withstand the usual jostling of retail inspection, and yet be readily removable at the point of sale.

Given the wide variety of product configurations displayed in this manner, most such hangers are specially designed to engage only a specific product at a specific point, thereby limiting use for display of different products and especially products which do not have a convenient point of attachment. Also, hangers with complex locking or engagement mechanisms are not easily removed from the articles by store personnel or purchasers.

SUMMARY OF THE PRESENT INVENTION

The present invention provides a product display clip for suspension of products from a product display structure. The display clip has a hinged front and back panels which are foldable into a closed and locked position to form a channel which folds around and entraps a portion of the product to be displayed. The product is easily releasable from the clip by disengaging an overlapping tab lock between the front and back panels.

In accordance with one aspect of the invention, a hinged product display clip for gripping a product for suspension from a product display structure has a front panel with a hook and a dual axis hinge member integrally attached along a first hinge at a lateral edge of the front panel and along a second hinge at a lateral edge of a rear panel whereby the panels are foldable to form a product-receiving channel and lockable in a closed position to firmly grip a product for suspended display from the clip.

These and other aspects of the invention are herein described in particularized detail with reference to the accompanying to the annexed Figures.

DETAILED DESCRIPTION OF A PREFERRED EMBODIMENT

Figure 5:
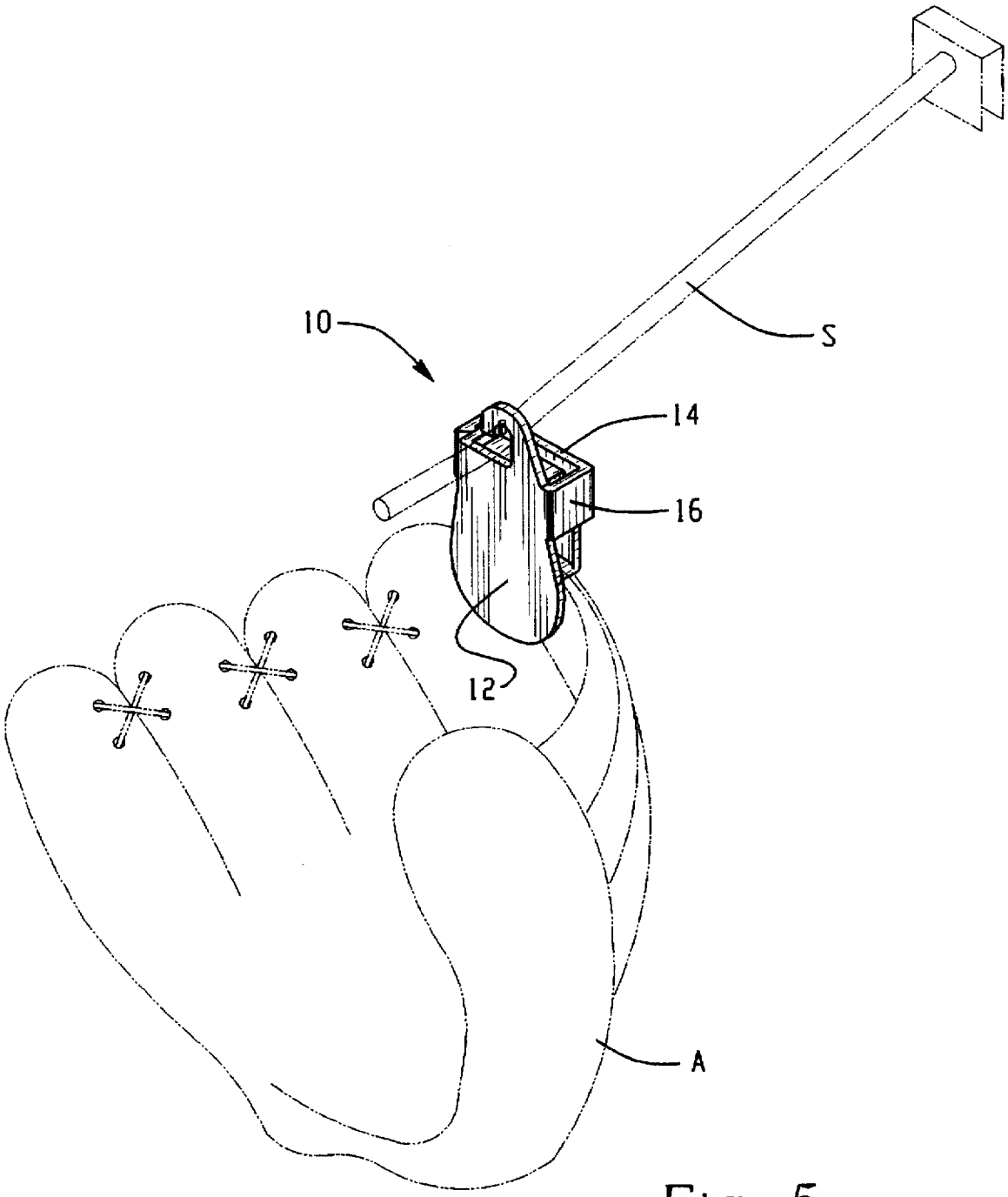
FIG. 5 is a perspective view of the Hinged Product Display Clip of the present invention in situ with a support arm of a retail display structure.

As depicted by the Figures, a hinged product display clip, indicated generally at 10, has a generally planar front panel 12, a generally planar rear panel 14, and a dual axis hinge member 16 which adjoins the front and rear panels along hinges 15 and 17. A hook 18, dimensioned for engagement with a product display or support structure (as shown in FIG. 5) and having a lateral opening 19 is integrally formed in a top area of front panel 12. Suspension of the clip 10 by hook 18 upon a support element of a product display structure orients the front and rear panels in a generally vertical position as shown. The frontal surface of front panel 12 provides an area for adhesive application or relief molding of indicia such as trademarks and product data.

Figure 1:
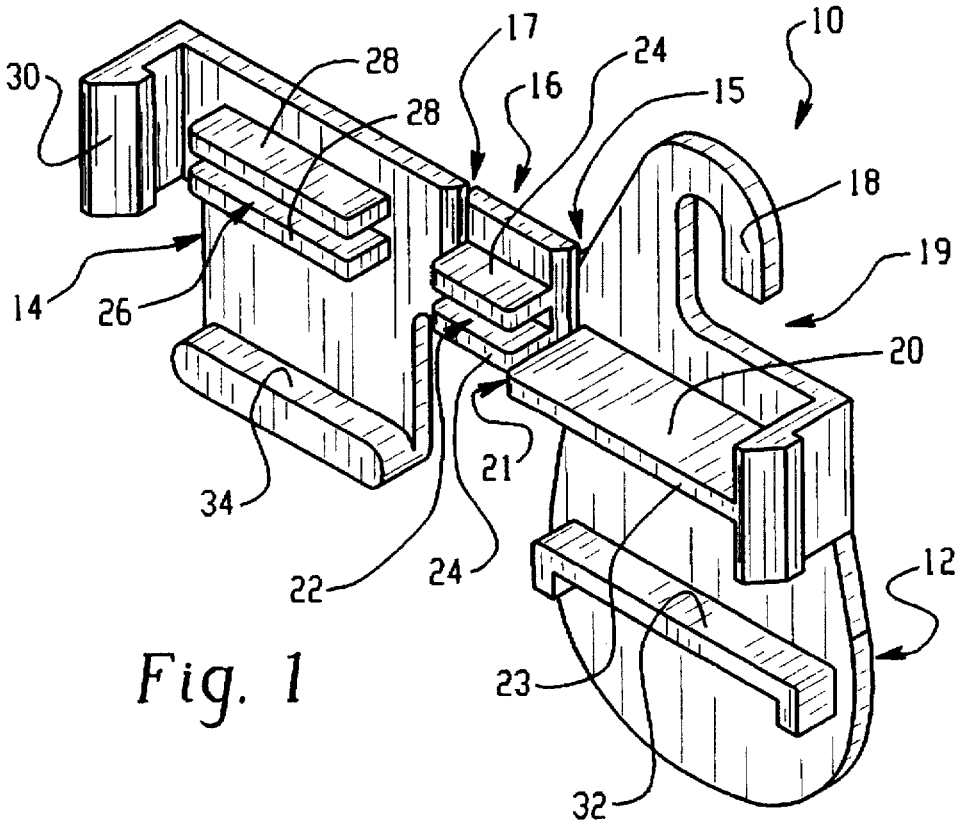
FIG. 1 is a perspective view of the Hinged Product Display Clip of the present invention.
Figure 2:
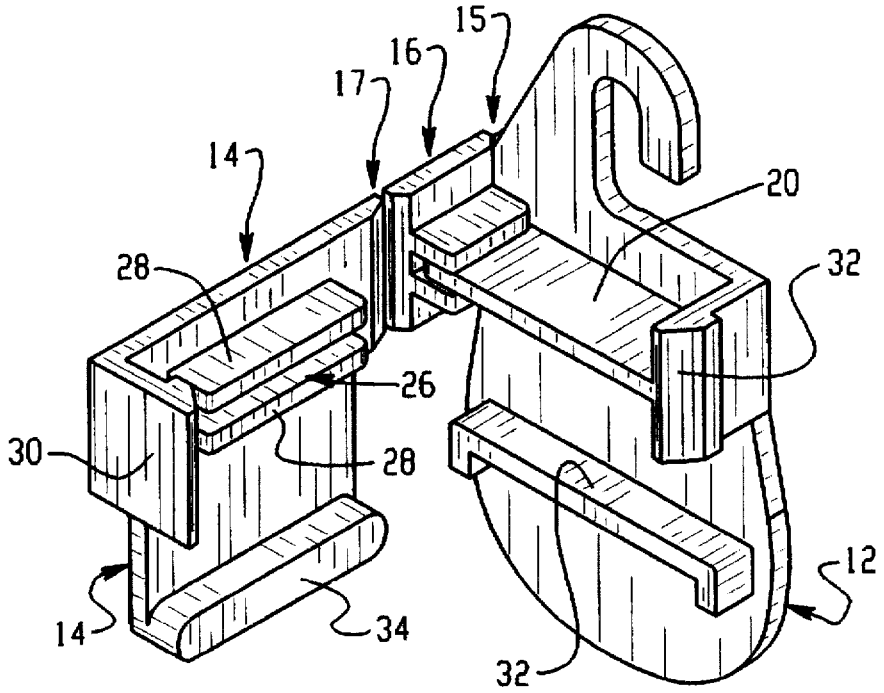
FIG. 2 is a perspective view of the Hinged Product Display Clip of the present invention.
Figure 3:
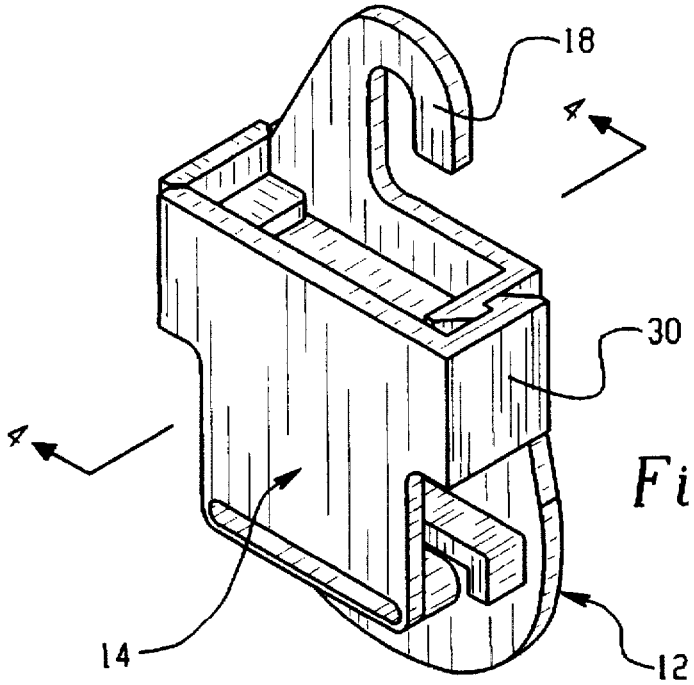
FIG. 3 is a perspective view of the Hinged Product Display Clip of the present invention.

As shown in FIGS. 1–3, hinge member 16 and rear panel 14 are foldable about hinges 15 and 17 relative to front panel 12 to form a product-receiving channel C which entraps a portion of a product to be suspended by the clip. When the clip is constructed as a single integrated piece, such as for example by plastic injection molding, hinges 15 and 17 are formed with a thickness substantially less than that of the front and rear panels and hinge member 16 to thereby allow flexing in the manner of hinge between the adjoined parts.

Figure 4:
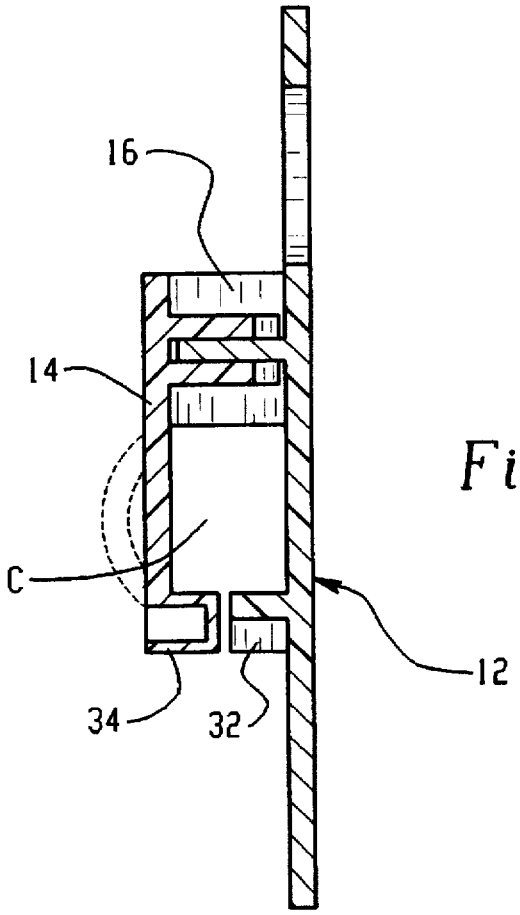
FIG. 4 is s a cross-sectional view of the Hinged Product Display Clip of the present invention taken) in the direction of the arrows 4—4 in FIG. 3.

Front panel 12 further includes a posterior extending locking guide flange 20 which has a lateral edge 21 which is received in a first closing guide channel 22 formed by parallel flanges 24 of hinge member 16, and a rear edge 23 of which is received in a second closing guide channel 26 formed by parallel flanges 28 of rear panel 14. The overlapping engagement of the guide channels of the hinge member and rear panel with the closing guide flange of the front panel provides a rigid structure with the clip in the closed configuration shown in FIG. 3. Front panel 12 further includes a channel base flange 32, and rear panel 14 further includes a channel base flange 34 which aligns with flange 32 to form a base to the product-receiving channel C. As shown in FIGS. 4 and 5, the abutting faces of flanges 32 and 34 may be spaced apart a selected distance to accommodate passage therethrough and achieve mechanical clamping of a portion of the displayed product. For example, if a standard thickness of the portion of the product which passes between the channel base flanges 32 and 34 is ⅛ of one inch, the abutting faces of the flanges may be spaced apart this approximate distance or less. The lower portion of rear panel 14 may deflect slightly away from front panel 12 to accommodate a product having a greater thickness, but is designed not to deflect to an extent which would allow a captured article to fall from the channel C. Alternatively, the generally planar portion of the rear panel between the guide channel and the channel base flange may be radiused outward (as shown in phantom in FIG. 4).

A beveled locking tab 30 extends from rear panel 14 to overlappingly engage a corresponding latch tab 33 which extends from front panel 12 as shown in FIG. 3. A lateral edge of locking guide flange 20 preferably intersects latch tab 33 to increase structural rigidity of the front panel/latch configuration and strengthen the locking mechanism of the tab and latch. With the rear panel securely locked against the front panel in this manner, the channel C is rigidly defined and an article captured and gripped therein not freely released.

In the example shown in FIG. 5, article A, for example in the form of a baseball glove, is captured at its web in the product receiving channel C for suspension from product display structure S in an orientation which affords easy consumer access and inspection.

The invention thus provides an adaptable clip for suspending articles from a hanging point by forming a product-receiving channel between a front panel and a rear panel connected by a dual hinged member and locked upon the article by interlocking engagement of the front and rear panels. The product-receiving channel provides sufficient area between the front and rear panels to receive a portion of the article above abutting channel base flanges which prevent the article from falling out of the channel. Although the clip has been described with respect to use in product display, the basic concept of the invention of providing hinge articulated front and rear panels which when locked in a closed position form an article-gripping structure is applicable to a wide variety of mechanical arrangements for product display.

What is claimed is:

1. A product display clip for gripping a product for suspended display upon a product display structure, the product display clip comprising:

a front panel having an integrally formed hook dimensioned for engagement upon a support element of a product display structure, the front panel further comprising a closing guide flange, a channel base flange below the closing guide flange, and a locking latch, a hinge member connected along a first hinge to a lateral edge of the front panel and connected along a second hinge to a lateral edge of a rear panel, the rear panel having parallel flanges which form a closing guide channel, a channel base flange below the parallel flanges, and a locking tab positioned to engage the locking latch of the front panel when the rear panel is closed parallel to the front panel about the first and second hinges, whereby a product-receiving channel is formed between a parallel flange and a channel base flange, wherein a portion of a product can be captured for suspended display by the product display clip.

2. The product display clip of claim 1 further comprising parallel flanges which extend from an interior side of the hinge member to form a closing guide channel which receives a portion of the closing guide flange of the front panel when the rear panel is closed in a position parallel to the front panel.

3. A product display clip for gripping a product for suspended display from a product display structure, the product display clip comprising:

a front panel having an integrally formed hook, a hinge member attached along a first hinge to an edge of the front panel and attached along a second hinge to an edge of a rear panel, the hinge member and rear panel articulable about the first and second hinges to allow the rear panel to be opened relative to the first panel to a position substantially in a common plane with the front panel, and to be closed relative to the first panel in a position opposed and parallel to the front panel;

a guide flange extending from an interior side of the front panel;

parallel flanges which extend from an interior side of the rear panel and aligned with the guide flange of the front panel whereby the guide flange is received between the parallel flanges when the rear panel is closed relative to the front panel;

the front panel further having a channel base flange which extends from an interior side below the guide flange, and the rear panel further having a channel base flange which extends from an interior side below the parallel flanges, whereby a product-receiving channel (C) is formed between a parallel flange and a channel base flange when the rear panel is in a closed position opposed and parallel to the front panel.

4. The product display clip of claim 3 further comprising a locking tab on the rear panel and a latch tab on the front panel operative to lock the front and rear panels in a closed position with the rear panel opposed and parallel to the front panel.

5. The product display clip of claim 3 further comprising hinge guide channels which extend from an interior side of the hinge member and positioned to receive a portion of the guide flange when the clip is in a closed position.

* * * * *